US008518244B2

(12) United States Patent
Schorfheide et al.

(10) Patent No.: US 8,518,244 B2
(45) **Date of Patent: *Aug. 27, 2013**

(54) HYDROTREATING PROCESS WITH IMPROVED HYDROGEN MANAGEMENT

(75) Inventors: James J. Schorfheide, Oak Hill, VA (US); Sean C. Smyth, Schoten (BE); Bal K. Kaul, Fairfax, VA (US); David L. Stern, Fairfax, VA (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 324 days.

This patent is subject to a terminal disclaimer.

(21) Appl. No.: 11/795,547

(22) PCT Filed: Jan. 23, 2006

(86) PCT No.: PCT/US2006/002292

§ 371 (c)(1),
(2), (4) Date: Jan. 6, 2010

(87) PCT Pub. No.: WO2006/079024

PCT Pub. Date: Jul. 27, 2006

(65) Prior Publication Data

US 2010/0108571 A1 May 6, 2010

(51) Int. Cl.
*C10G 45/02* (2006.01)

(52) U.S. Cl.
USPC ..... 208/212; 208/209; 208/213

(58) Field of Classification Search
USPC ..... 208/208 R, 209, 212, 213, 216 R, 208/217
See application file for complete search history.

(56) References Cited

U.S. PATENT DOCUMENTS

| | | | | |
|---|---|---|---|---|
| 4,077,779 | A | 3/1978 | Sircar et al. | |
| 4,194,892 | A | 3/1980 | Jones et al. | |
| 5,540,758 | A | 7/1996 | Agrawal et al. | |
| 6,063,161 | A | 5/2000 | Keefer et al. | |
| 6,361,583 | B1 | 3/2002 | Pinnau et al. | |
| 6,406,523 | B1 | 6/2002 | Connor et al. | |
| 6,451,095 | B1 | 9/2002 | Keefer et al. | |
| 6,488,747 | B1 | 12/2002 | Keefer et al. | |
| 6,533,846 | B1 | 3/2003 | Keefer et al. | |
| 6,565,635 | B2 | 5/2003 | Keefer et al. | |
| 6,607,584 | B2 | 8/2003 | Moreau et al. | |
| 2004/0255778 | A1 | 12/2004 | Reddy | |
| 2006/0118466 | A1 * | 6/2006 | Galeazzi et al. | 208/210 |

FOREIGN PATENT DOCUMENTS

| | | | |
|---|---|---|---|
| EP | 1004343 | | 5/2000 |
| WO | WO 03/044131 | * | 5/2003 |
| WO | 03068366 | | 8/2003 |

OTHER PUBLICATIONS

R. Farrauto, S. Hwang, L. Shore, W. Ruettinger, J. Lampert, T. Giroux, Y. Liu and O. Llinich, "New Material Needs for Hydrocarbon Fuel Processing: Generating Hydrogen for the PEM Fuel Cell," Annual Review of Materials Research, vol. 33: 1-27 (Volume publication date Aug. 2003).

* cited by examiner

*Primary Examiner* — Prem C Singh
*Assistant Examiner* — Renee E Robinson
(74) *Attorney, Agent, or Firm* — Bruce M. Bordelon

(57) ABSTRACT

This invention relates to an improved hydrotreating process for removing sulfur from naphtha and distillate feedstreams. This improved process utilizes a hydrotreating zone, an acid gas removal zone, and a pressure swing adsorption zone having a total cycle time of less than about 30 seconds for increasing the concentration of hydrogen utilized in the process.

19 Claims, 2 Drawing Sheets

HYDROTREATING PROCESS WITH IMPROVED HYDROGEN MANAGEMENT

FIELD OF THE INVENTION

This invention relates to an improved hydrotreating process for removing sulfur from naphtha and distillate feedstreams. This improved process utilizes a hydrotreating zone, an acid gas removal zone, and a pressure swing adsorption zone having a total cycle time of less than about 1 minute for increasing the concentration of hydrogen utilized in the process.

BACKGROUND OF THE INVENTION

Hydrotreating processes are used by petroleum refiners to remove heteroatoms, such as sulfur and nitrogen, from hydrocarbonaceous streams such as naphtha, kerosene, diesel, gas oil, vacuum gas oil (VGO), and reduced crude. Hydrotreating severity is selected to balance desired product yield against the desired low levels of heteroatoms. Increasing regulatory pressure in the United States and abroad has resulted in a trend to increasingly severe and/or selective hydrotreating processes to form hydrocarbon products having very low levels of sulfur.

Hydrotreating is generally accomplished by contacting a hydrocarbonaceous feedstock in a hydrotreating reaction vessel, or zone, with a suitable hydrotreating catalyst under hydrotreating conditions of elevated temperature and pressure in the presence of a hydrogen-containing treat gas to yield a product having the desired level of sulfur. The operating conditions and the hydrotreating catalysts used will influence the quality of the resulting hydrotreated products.

It is conventional, i.e., known to those skilled in the art of hydrotreating and other forms of hydroprocessing, to separate and recycle at least a portion of the unreacted hydrogen in the hydrotreated product so that it can be combined with the fresh treat gas (also known as make-up gas) and the hydrocarbon feed. This separation is accomplished in, for example, a flash drum or separator vessel downstream of the hydrotreating reactor. It is also desirable to improve the purity (concentration) of hydrogen in the recycle stream. Thus, it has been the goal of the art to provide enhanced efficiencies of hydrogen utilization with little additional energy consumption and without undue deleterious effects on the maintenance or operation of the hydrotreating equipment. It has also been recognized that by increasing the efficient use of hydrogen, existing equipment could be employed to increase the throughput of the feedstock resulting in higher product yields. A further advantage to the more efficient utilization of hydrogen is the reduction in the amount of make-up hydrogen that must be provided by, for example, a hydrogen plant or cryo-unit.

The type of feedstock to be processed, product quality requirements, yield, and the amount of conversion for a specific catalyst cycle life determines the hydrogen partial pressure required for the operation of a hydrotreating unit. The unit's operating pressure and the treat gas purity determine the hydrogen partial pressure of the hydrotreating unit. Since there is limited control over the composition of the flashed gas from the downstream hydrotreater separator or flash drum, the hydrogen composition of the recycle flash gas limits the hydrogen partial pressure ultimately delivered to the hydrotreater reactor. When recycle is used, a relatively lower hydrogen partial pressure in the recycle gas stream effectively lowers the partial pressure of the hydrogen gas input component to the reactor and thereby adversely affects the operating performance with respect to product quantity and quality, catalyst cycle life, etc. To offset this lower performance, the operating pressure of the hydrotreating reactor has to be increased, which can be undesirable from an operational point of view. Conversely, by increasing the efficiency of hydrogen gas recovery and hydrogen concentration, the hydrogen partial pressure of the recycle gas stream is improved. This results in an overall improved performance of the hydrotreating process unit as measured by these parameters.

Some conventional methods have been proposed that attempt to improve the hydrogen utilization efficiency of the hydrotreating unit by increasing the concentration of the hydrogen in the recycle gas stream. Such processes typically result in significant additional equipment costs and/or require significant changes in operating conditions, such as temperature and pressure, which typically results in increased capital and operating costs.

One process that has been adopted to improve the hydrogen purity of the recycle stream in a hydroprocessing unit is conventional pressure swing adsorption. See, for example, U.S. Pat. No. 4,457,384 issued Jul. 3, 1984 to Lummus Crest, Inc. However, in order to incorporate the PSA unit, the pressure of the reactor effluent gas stream must be reduced from about 2,500 psig (175.8 kg/cm$^2$) to about 350 psig (24.6 kg/cm$^2$). Although the purity of the recycle hydrogen stream can be increased to about 99 mol %, the recycled gaseous stream must be subjected to compression to return it to 2,500 psig (175.8 kg/cm$^2$) before introduction into the hydroprocessing feed stream. The net result is that the capital, operating and maintenance costs are substantially increased by the addition of a large compressor that is required when using a conventional PSA unit.

Another method is described in U.S. Pat. No. 4,362,613 to MacLean which uses membranes with pressure drops up to 150 atmospheres and which also incurs substantial capital investment and operating costs.

There is therefore a need for an improved process for enhancing the efficiency of hydrogen utilization by means that are compatible with existing hydrotreating units. It is desired that such a process would not adversely affect the hydrotreater throughput or the overall economies of the system, including capital expenditures and operating expenditures, the latter including maintenance and energy consumption.

In other words, although various hydrotreating processes are practiced commercially, there is still a need in the art for improved hydrotreating processes that can be practiced more efficiently and with higher reactor throughput.

SUMMARY OF THE INVENTION

In one embodiment, the present invention includes a process for removing sulfur and other heteroatoms from a hydrocarbon feed, comprising:

a) contacting the hydrocarbon feed in a hydrotreating zone with hydrogen and a catalytically effective amount of a hydrotreating catalyst under hydrotreating conditions thereby resulting in a hydrotreated product comprised of a liquid phase and a vapor phase containing hydrogen and light hydrocarbons;

b) separating the liquid phase and the vapor phase from the hydrotreated product;

c) removing light hydrocarbons from the vapor phase in a rapid cycle pressure swing adsorption unit containing a plurality of adsorbent beds and having a total cycle time of less than about 30 seconds and a pressure drop within each adsorbent bed of greater than about 5 inches of water per foot of bed length to produce a purified recycle gas with a higher hydrogen concentration by vol % than the vapor phase; and d) recycling at least a portion of the purified recycle gas to the hydrotreating zone.

In another embodiment, light hydrocarbons are removed from a hydrogen-containing make-up gas in a rapid cycle pressure swing adsorption unit containing a plurality of adsorbent beds and having a total cycle time of less than about 30 seconds and a pressure drop within each adsorbent bed of greater than about 5 inches of water per foot of bed length, to produce a purified make-up gas with a higher hydrogen concentration by vol % than the hydrogen-containing make-up gas, and the hydrogen utilized in the hydrotreating zone is comprised of at least a portion of the purified make-up gas.

In still another embodiment, the present invention includes a process for removing sulfur and other heteroatoms from a hydrocarbon feed, comprising:

a) contacting the hydrocarbon feed in a hydrotreating zone with hydrogen and a catalytically effective amount of a hydrotreating catalyst under hydrotreating conditions thereby resulting in a hydrotreated product comprised of a liquid phase and a vapor phase containing hydrogen, hydrogen sulfide and light hydrocarbons;

wherein at least a portion of the hydrogen is a purified make-up gas produced by removing light hydrocarbons from a hydrogen-containing make-up gas in a rapid cycle pressure swing adsorption containing a plurality of adsorbent beds and having a total cycle time of less than about 30 seconds and a pressure drop within each adsorbent bed of greater than about 5 inches of water per foot of bed length; and wherein the purified make-up gas has a higher hydrogen concentration by vol % than the hydrogen-containing make-up gas;

b) separating the liquid phase and the vapor phase from the hydrotreated product; and c) recycling at least a portion of the vapor phase to the hydrotreating zone.

In one preferred embodiment, the total cycle time of the rapid cycle pressure swing adsorption process is less than about 10 seconds and the pressure drop is greater than about 10 inches of water per foot of bed length.

In another preferred embodiment, the total cycle time of the rapid cycle pressure swing adsorption process is less than about 5 seconds the pressure drop is greater than about 20 inches of water per foot of bed length.

In still another preferred embodiment, the hydrotreating catalyst contains at least one of cobalt, nickel, tungsten, alumina, silica, silica-alumina, a zeolite, and a molecular sieve.

DETAILED DESCRIPTION OF THE INVENTION

In an embodiment, a process is provided for hydrotreating a hydrocarbon feed. Non-limiting examples of a hydrocarbon feed include both naphtha and/or distillate boiling range hydrocarbonaceous feeds. Non-limiting examples of such naphtha feedstreams are those containing components boiling in the range from about 50° F. to about 450° F. (about 10 to about 232° C.), at atmospheric pressure. The naphtha feedstock generally contains one or more cracked naphthas such as fluid catalytic cracking unit naphtha (FCC catalytic naphtha), coker naphtha, hydrocracker naphtha, resid hydrotreater naphtha, debutanized natural gasoline (DNG), and gasoline blending components from other sources wherein a naphtha boiling range stream can be produced. In another embodiment, the feedstream may be comprised of kerosene and jet fuel fractions boiling in the range of about 300 to about 500° F. (about 149 to about 260° C.). In still another embodiment, distillate feedstreams can be hydrotreated, such as those boiling in the range of about 450 to about 800° F. (about 232 to about 427° C.), e.g., atmospheric gas oils, vacuum gas oils, deasphalted vacuum and atmospheric residua, mildly cracked residual oils, coker distillates, straight run distillates, solvent-deasphalted oils, pyrolysis-derived oils, high boiling synthetic oils, cycle oils and cat cracker distillates. A preferred hydrotreating feedstock is a gas oil or other hydrocarbon fraction having at least 50% by weight, and most usually at least 75% by weight of its components boiling at temperatures between about 600° F. (316° C.) and 1000° F. (538° C.). The term "hydrocarbon feed" encompasses one or more refinery, chemical or other industrial plant streams that is comprised of hydrocarbons, including such streams wherein small levels (less than 5 wt %) of non-hydrocarbon contaminants such as, but not limited to, sulfur, water, ammonia, and metals may be present in the hydrocarbon feed.

Figure 1:
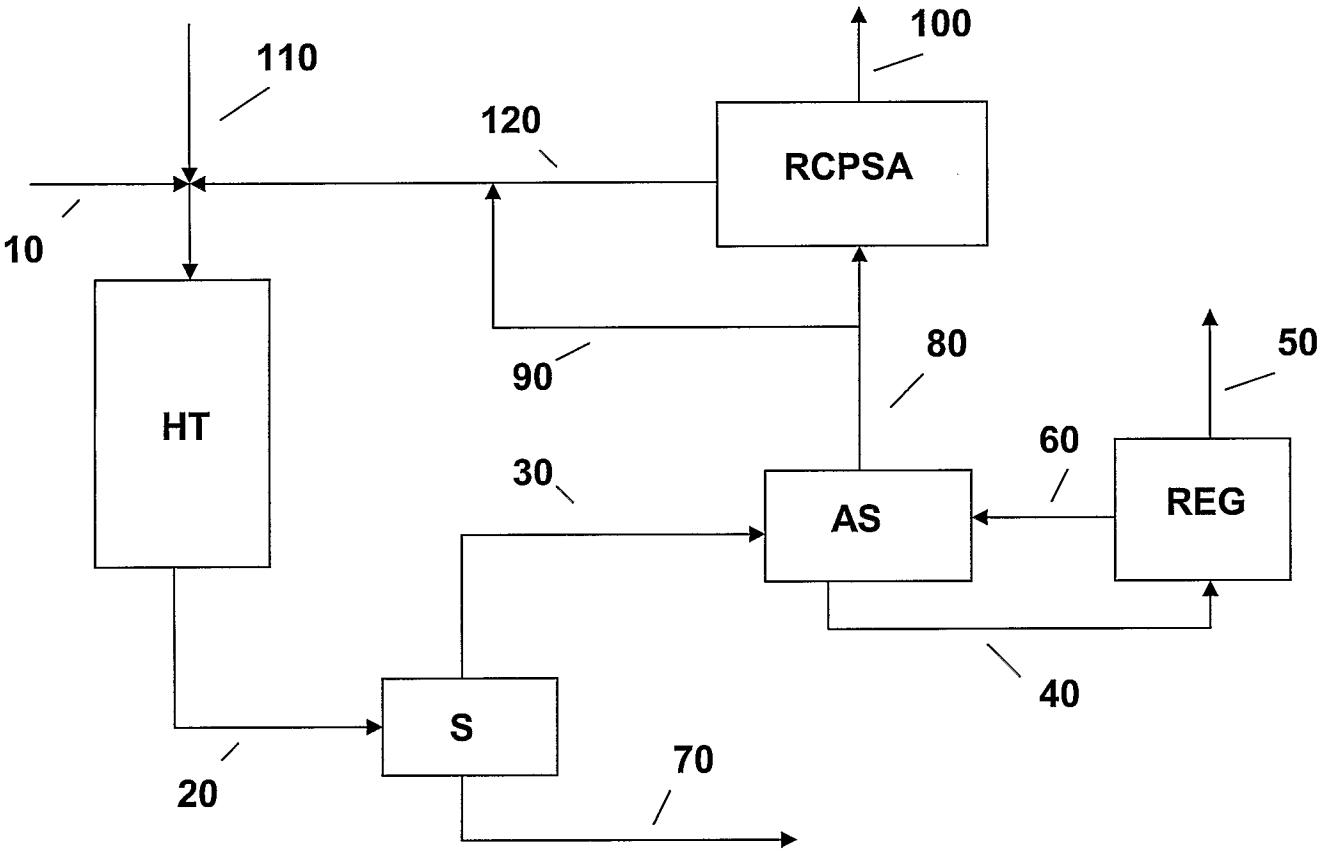
FIG. 1 is a simplified schematic of one preferred embodiment of the present invention wherein a RCPSA application is utilized in the hydrogen-containing recycle gas stream of a single stage hydrotreating unit.

FIG. 1 hereof illustrates an embodiment wherein Rapid Cycle Pressure Swing Adsorption ("RCPSA") is utilized in the hydrogen-containing recycle gas stream of a single stage hydrotreating unit. The hydrocarbon feed to be treated is conducted via line 10 to hydrotreating reactor HT where it is contacted with the purified recycle gas stream via line 120, hydrogen-containing make-up gas via line 110 and a hydrotreating catalyst at hydrotreating conditions. The term "hydrotreating" as used herein refers to processes wherein a hydrogen-containing treat gas is used in the presence of suitable catalysts which are primarily active for the removal of heteroatoms, such as sulfur and nitrogen and for some hydrogenation of aromatics. Suitable hydrotreating catalysts are those effective for the catalytic hydrotreating of the selected feed under catalytic conversion conditions, including those comprised of at least one Group VIII metal, preferably iron, cobalt and nickel, more preferably cobalt and/or nickel and at least one Group VI metal, preferably molybdenum and tungsten, on a high surface area support material, such as alumina, silica, and the like. Depending on the selected feed, zeolite-containing catalysts are suitable as well as noble metal-containing catalysts including those where the noble metal is selected from palladium and platinum. In an embodiment, more than one type of hydrotreating catalyst is used in a single reaction vessel. The Group VIII metal is typically present in an amount ranging from about 2 to about 20 wt. %, preferably from about 4 to about 12 wt. %. The Group VI metal will typically be present in an amount ranging from about 1 to about 25 wt-%, preferably from about 2 to about 25 wt. %. Non-limiting examples of hydrotreating catalyst materials include cobalt, nickel, molybdenum, platinum, tungsten, alumina, silica, silica-alumina, a zeolite, or a molecular sieve.

As previously mentioned, typical hydrotreating temperatures range from about 400° F. (204° C.) to about 900° F. (482° C.) with pressures from about 500 to about 2500 psig (about 3.5 to about 17.3 MPa), preferably from about 500 to about 2000 psig (3.5 to about 13.8 MPa), and a liquid hourly space velocity of the feedstream from about 0.1 $hr^{-1}$ to about 10 $hr^{-1}$.

The resulting hydrotreater effluent 20 leaves the hydrotreating reactor HT is conducted to a separation zone S, preferably operated at a temperature from about 300° F. (149° C.) to about 800° F. (426° C.) to produce a first vapor phase stream containing hydrogen, hydrogen sulfide and light hydrocarbon compounds and a liquid phase product stream containing substantially lower levels of sulfur than the feedstream which collected via line 70. The term "light hydrocarbons" means a hydrocarbon mixture comprised of hydrocarbon compounds of about 1 to about 5 carbon atoms in weight (i.e., $C_1$ to $C_5$ weight hydrocarbon compounds). The first vapor phase stream is conducted via line 30 to an acid gas scrubbing zone AS to reduce the concentration of heteroatom species such as hydrogen sulfide so as to produce a scrubbed vapor stream. This scrubbed vapor stream will generally contain from about 40 vol. % to about 80 vol. % hydrogen, with the remainder being primarily light hydrocarbons. Any suitable basic solution can be used in the acid gas scrubbing zone AS that will absorb the desired level of acid gases, preferably hydrogen sulfide, from the vapor stream. Non-limiting examples of such basic solutions are the amines, preferably diethanol amine, mono-ethanol amine, and the like. Diethanol amine is more preferred. The $H_2S$-rich scrubbing solution, which has absorbed at least a portion, preferably substantially all, of the hydrogen sulfide, is conducted to a regeneration zone REG via line 40 where substantially all of the hydrogen sulfide is stripped therefrom by use of a stripping agent, preferably steam. The $H_2S$-rich stream exits regenerator REG via line 50 and will typically be sent to a sulfur recovery plant, such as a Claus plant. The $H_2S$-lean scrubbing solution will be recycled to acid gas scrubbing zone AS via line 60.

The resulting scrubbed vapor stream, which is now substantially free of hydrogen sulfide, is conducted from acid gas scrubbing zone AS to a rapid cycle pressure swing adsorption unit (RCPSA) via line 80 where light hydrocarbons are removed. Depending on the specific RCPSA design, other contaminants, such as, but not limited to $CO_2$, water, and ammonia may also be removed from a feed. A portion of the scrubbed vapor stream may bypass the RCPSA unit via line 90 if desired.

A tail gas stream comprised of light hydrocarbons and contaminants is removed from the RCPSA zone via line 100. The resulting purified recycle gas stream 120 will be richer in hydrogen on a volume basis than the scrubbed vapor stream to the RCPSA unit. That is, in this application, the hydrogen content of the purified recycle gas stream from the RCPSA will be preferably at least 10% greater in hydrogen by vol % than the inlet stream to the RCPSA, more preferably at least 20% greater in hydrogen by vol %, and even more preferably at least 30% greater in hydrogen by vol %. The purified recycle gas stream may be combined with any portion of the scrubbed vapor stream that has been optionally bypassed around the RCPSA unit via line 90, and combines with the incoming hydrogen-containing make-up gas via line 110 and the incoming hydrocarbon feed via line 10 to be combined for introduction into the hydrotreating reactor HT.

Figure 2:
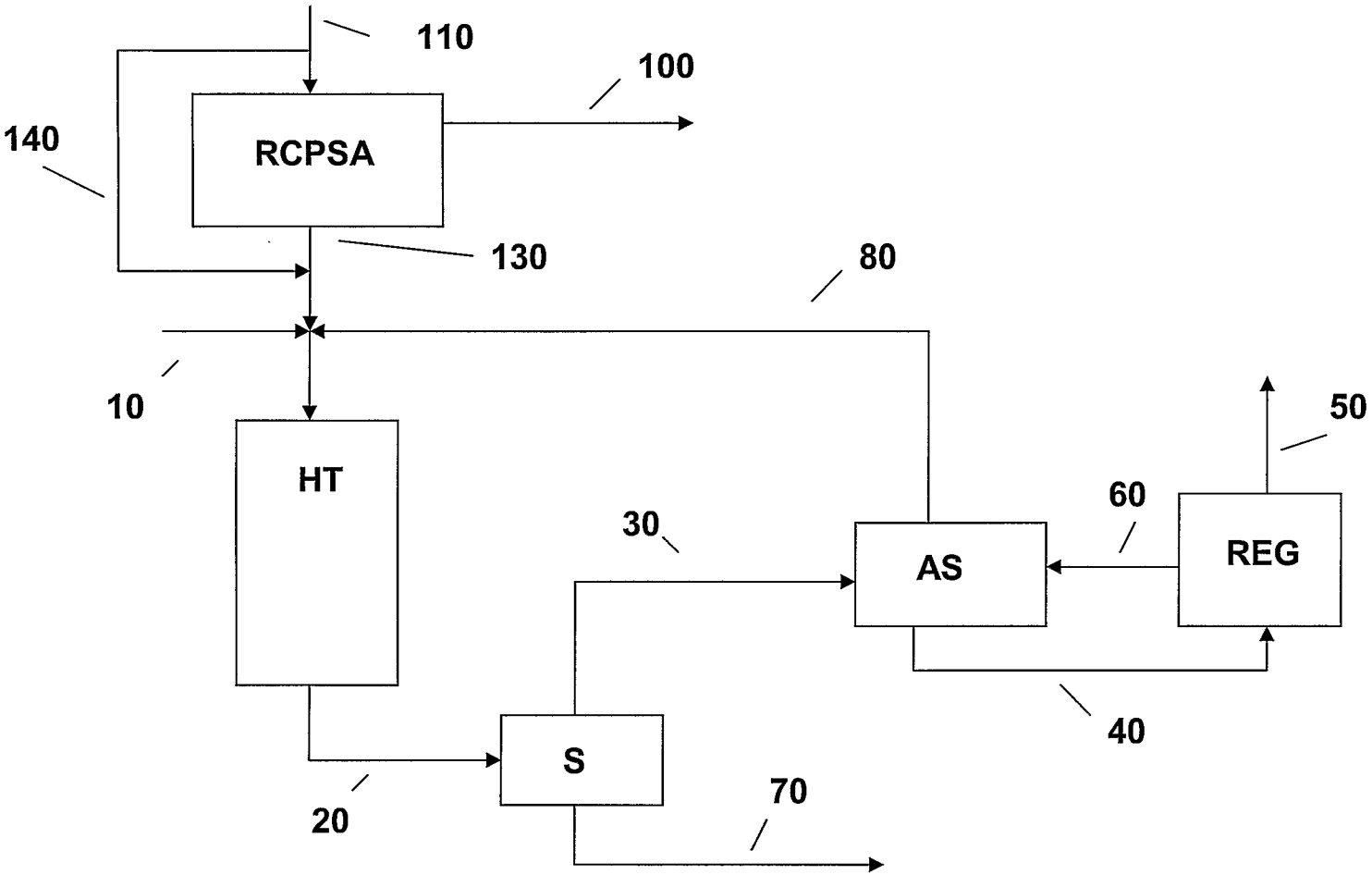
FIG. 2 is a simplified schematic of one preferred embodiment of the present invention wherein a RCPSA application is utilized in the hydrogen-containing make-up gas stream of a single stage hydrotreating unit.

FIG. 2 hereof illustrates another embodiment wherein a RCPSA application is utilized in the hydrogen-containing make-up gas stream of a single stage hydrotreating unit. Here, a hydrogen-containing make-up stream is processed in a RCPSA unit to increase its hydrogen concentration and/or remove specific contaminant's. The hydrogen-containing make-up stream to the inlet of the RCPSA unit can conducted from outside the refinery or from one or more process units within the refinery that generates hydrogen either as a side product or as a predominant product, such as, but not limited to, a reforming unit or a hydrogen plant. All elements in FIG. 2 have the same functionality as in FIG. 1 except that in FIG. 2, an RCPSA unit is not installed in the recycle stream downstream of the acid gas scrubbing zone AS as is shown in FIG. 1. Instead, as shown in the embodiment of FIG. 2, the scrubbed vapor stream 80 returns to be combined with a hydrogen-containing purified make-up gas stream via line 130 and the incoming hydrocarbon feed via line 10.

Continuing with FIG. 2, the incoming hydrogen-containing make-up stream 110 is passed through a rapid cycle pressure swing adsorption unit (RCPSA) where light hydrocarbons and contaminants are removed via line 100. The resulting purified make-up gas stream 130 will be richer in hydrogen than the incoming hydrogen-containing make-up stream to the inlet of the RCPSA unit. That is, the hydrogen content of the purified make-up gas stream from the RCPSA will be preferably at least 10% greater in hydrogen by vol % than the hydrogen-containing make-up stream to the inlet of the RCPSA and more preferably at least 20% greater in hydrogen by vol %. However, it should be noted that the increase in hydrogen purity is dependent upon the purity of the stream to be treated. Many hydrogen-containing make-up gas systems are often of high hydrogen purity, often as high as 80 to 95 vol % hydrogen. Therefore, a RCPSA treatment of a make-up gas may be beneficial for less than 10% increase in hydrogen purity where high hydrogen purity is required. A portion of the incoming hydrogen-containing make-up stream may also bypass the RCPSA unit and be conducted directly to the hydrotreater HT via line 140 if desired.

In another embodiment, two RCPSA units are installed in a single hydrotreating unit wherein a RCPSA unit is installed to purify at least a portion of the recycle gas stream of the hydrotreating unit (i.e., the scrubbed vapor stream) as shown as RSPCA in FIG. 1 and a RCPSA unit is installed to purify the incoming hydrogen-containing make-up gas to the hydrotreating unit as shown as RSPCA in FIG. 2. In yet another embodiment, RCPSA may be applied to a two stage hydrotreating unit. In this embodiment an RCPSA unit may be installed in the hydrogen-containing make-up gas stream to the first stage hydrotreater reactor, the hydrogen-containing make-up gas stream to the second stage hydrotreater reactor, the scrubbed vapor stream recycled to the first stage hydrotreater reactor, or the scrubbed vapor stream recycled to the second stage hydrotreater reactor. In other embodiments, any combination of these four streams may be subjected to the RCPSA process depending upon the stream purity and hydrogen concentration needs and economics.

In Conventional Pressure Swing Adsorption ("conventional PSA") a gaseous mixture is conducted under pressure for a period of time over a first bed of a solid sorbent that is selective or relatively selective for one or more components, usually regarded as a contaminant that is to be removed from the gas stream. It is possible to remove two or more contaminants simultaneously but for convenience, the component or components that are to be removed will be referred to in the singular and referred to as a contaminant. The gaseous mixture is passed over a first adsorption bed in a first vessel and emerges from the bed depleted in the contaminant that remains sorbed in the bed. After a predetermined time or, alternatively when a break-through of the contaminant is observed, the flow of the gaseous mixture is switched to a second adsorption bed in a second vessel for the purification to continue. While the second bed is in adsorption service, the sorbed contaminant is removed from the first adsorption bed by a reduction in pressure, usually accompanied by a reverse flow of gas to desorb the contaminant. As the pressure in the vessels is reduced, the contaminant previously adsorbed on the bed is progressively desorbed into the tail gas system that typically comprises a large tail gas drum, together with a control system designed to minimize pressure fluctuations to downstream systems. The contaminant can be collected from the tail gas system in any suitable manner and processed further or disposed of as appropriate. When desorption is complete, the sorbent bed may be purged with an inert gas stream, e.g., nitrogen or a purified stream of the process gas. Purging may be facilitated by the use of a higher temperature purge gas stream.

After, e.g., breakthrough in the second bed, and after the first bed has been regenerated so that it is again prepared for adsorption service, the flow of the gaseous mixture is switched from the second bed to the first bed, and the second bed is regenerated. The total cycle time is the length of time from when the gaseous mixture is first conducted to the first bed in a first cycle to the time when the gaseous mixture is first conducted to the first bed in the immediately succeeding cycle, i.e., after a single regeneration of the first bed. The use of third, fourth, fifth, etc. vessels in addition to the second vessel, as might be needed when adsorption time is short but desorption time is long, will serve to increase cycle time.

Thus, in one configuration, a pressure swing cycle will include a feed step, at least one depressurization step, a purge step, and finally a repressurization step to prepare the adsorbent material for reintroduction of the feed step. The sorption of the contaminants usually takes place by physical sorption onto the sorbent that is normally a porous solid such as activated carbon, alumina, silica or silica-alumina that has an affinity for the contaminant. Zeolites are often used in many applications since they may exhibit a significant degree of selectivity for certain contaminants by reason of their controlled and predictable pore sizes. Normally, chemical reaction with the sorbent is not favored in view of the increased difficulty of achieving desorption of species which have become chemically bound to the sorbent, but chemisorption is my no means to be excluded if the sorbed materials may be effectively desorbed during the desorption portion of the cycle, e.g., by the use of higher temperatures coupled with the reduction in pressure. Pressure swing adsorption processing is described more fully in the book entitled *Pressure Swing Adsorption*, by D. M. Ruthven, S. Farouq & K. S. Knaebel (VCH Publishers, 1994).

Conventional PSA possesses significant inherent disadvantages for a variety of reasons. For example, conventional PSA units are costly to build and operate and are significantly larger in size for the same amount of hydrogen that needs to be recovered from hydrogen-containing gas streams as compared to RCPSA. Also, a conventional pressure swing adsorption unit will generally have cycle times in excess of one minute, typically in excess of 2 to 4 minutes due to time limitations required to allow diffusion of the components through the larger beds utilized in conventional PSA and the equipment configuration and valving involved. In contrast, rapid cycle pressure swing adsorption is utilized which has total cycle times of less than one minute. The total cycle times of RCPSA may be less than 30 seconds, preferably less than 15 seconds, more preferably less than 10 seconds, even more preferably less than 5 seconds, and even more preferably less 2 seconds. Further, the rapid cycle pressure swing adsorption units used can make use of substantially different sorbents, such as, but not limited to, structured materials such as monoliths.

The overall adsorption rate of the adsorption processes, whether conventional PSA or RCPSA, is characterized by the mass transfer rate constant in the gas phase ($\tau_g$) and the mass transfer rate constant in the solid phase ($\tau_s$). A material's mass transfer rates of a material are dependent upon the adsorbent, the adsorbed compound, the pressure and the temperature. The mass transfer rate constant in the gas phase is defined as:

$$\tau_g = D_g/R_g^2 \text{ (in cm}^2\text{/sec)} \quad (1)$$

where $D_g$ is the diffusion coefficient in the gas phase and $R_g$ is the characteristic dimension of the gas medium. Here the gas diffusion in the gas phase, $D_g$, is well known in the art (i.e., the conventional value can be used) and the characteristic dimension of the gas medium, $R_g$ is defined as the channel width between two layers of the structured adsorbent material.

The mass transfer rate constant in the solid phase of a material is defined as:

$$\tau_s = D_s/R_s^2 \text{ (in cm}^2\text{/sec)} \quad (2)$$

where $D_s$ is the diffusion coefficient in the solid phase and $R_s$ is the characteristic dimension of the solid medium. Here the gas diffusion coefficient in the solid phase, $D_s$, is well known in the art (i.e., the conventional value can be used) and the characteristic dimension of the solid medium, $R_s$ is defined as the width of the adsorbent layer.

D. M. Ruthven & C. Thaeron, *Performance of a Parallel Passage Absorbent Contactor*, Separation and Purification Technology 12 (1997) 43-60, which is incorporated by reference, clarifies that for flow through a monolith or a structured adsorbent that channel width is a good characteristic dimension for the gas medium, $R_g$. U.S. Pat. No. 6,607,584 to Moreau et al., which is incorporated by reference, also describes the details for calculating these transfer rates and associated coefficients for a given adsorbent and the test standard compositions used for conventional PSA. Calculation of these mass transfer rate constants is well known to one of ordinary skill in the art and may also be derived by one of ordinary skill in the art from standard testing data.

Conventional PSA relies on the use of adsorbent beds of particulate adsorbents. Additionally, due to construction constraints, conventional PSA is usually comprised of 2 or more separate beds that cycle so that at least one or more beds is fully or at least partially in the feed portion of the cycle at any one time in order to limit disruptions or surges in the treated process flow. However, due to the relatively large size of conventional PSA equipment, the particle size of the adsorbent material is general limited particle sizes of about 1 mm and above. Otherwise, excessive pressure drop, increased cycle times, limited desorption, and channeling of feed materials will result.

In an embodiment, RCPSA utilizes a rotary valving system to conduct the gas flow through a rotary sorber module that contains a number of separate adsorbent bed compartments or "tubes", each of which is successively cycled through the sorption and desorption steps as the rotary module completes the cycle of operations. The rotary sorber module is normally comprised of multiple tubes held between two seal plates on either end of the rotary sorber module wherein the seal plates are in contact with a stator comprised of separate manifolds wherein the inlet gas is conducted to the RCPSA tubes and processed purified product gas and the tail gas exiting the RCPSA tubes is conducted away from rotary sorber module. By suitable arrangement of the seal plates and manifolds, a number of individual compartments or tubes may pass through the characteristic steps of the complete cycle at any one time. In contrast with conventional PSA, the flow and pressure variations required for the RCPSA sorption/desorption cycle changes in a number of separate increments on the order of seconds per cycle, which smoothes out the pressure and flow rate pulsations encountered by the compression and valving machinery. In this form, the RCPSA module includes valving elements angularly spaced around the circular path taken by the rotating sorption module so that each compartment is successively passed to a gas flow path in the appropriate direction and pressure to achieve one of the incremental pressure/flow direction steps in the complete RCPSA cycle. One key advantage of the RCPSA technology is a significantly more efficient use of the adsorbent material. The quantity of adsorbent required with RCPSA technology can be only a fraction of that required for conventional PSA technology to achieve the same separation quantities and qualities. As a result, the footprint, investment, and the amount of active adsorbent required for RCPSA is significantly lower than that for a conventional PSA unit processing an equivalent amount of gas.

In an embodiment, RCPSA bed length unit pressure drops, required adsorption activities, and mechanical constraints (due to centrifugal acceleration of the rotating beds in RCPSA), prevent the use of many conventional PSA adsorbent bed materials, in particular adsorbents that are in a loose pelletized, particulate, beaded, or extrudate form. In a preferred embodiment, adsorbent materials are secured to a supporting understructure material for use in an RCPSA rotating apparatus. For example, one embodiment of the rotary RCPSA apparatus can be in the form of adsorbent sheets comprising adsorbent material coupled to a structured reinforcement material. A suitable binder may be used to attach the adsorbent material to the reinforcement material. Non-limiting examples of reinforcement material include monoliths, a mineral fiber matrix, (such as a glass fiber matrix), a metal wire matrix (such as a wire mesh screen), or a metal foil (such as aluminum foil), which can be anodized. Examples of glass fiber matrices include woven and non-woven glass fiber scrims. The adsorbent sheets can be made by coating a slurry of suitable adsorbent component, such as zeolite crystals with binder constituents onto the reinforcement material, non-woven fiber glass scrims, woven metal fabrics, and expanded aluminum foils. In a particular embodiment, adsorbent sheets or material are coated onto ceramic supports.

An absorber in a RCPSA unit typically comprises an adsorbent solid phase formed from one or more adsorbent materials and a permeable gas phase through which the gases to be separated flow from the inlet to the outlet of the adsorber, with a substantial portion of the components desired to be removed from the stream adsorbing onto the solid phase of the adsorbent. This gas phase may be called "circulating gas phase", but more simply "gas phase". The solid phase includes a network of pores, the mean size of which is usually between approximately 0.02 μm and 20 μm. There may be a network of even smaller pores, called "micropores", this being encountered, for example, in microporous carbon adsorbents or zeolites. The solid phase may be deposited on a non-adsorbent support, the primary function of which is to provide mechanical strength for the active adsorbent materials and/or provide a thermal conduction function or to store heat. The phenomenon of adsorption comprises two main steps, namely passage of the adsorbate from the circulating gas phase onto the surface of the solid phase, followed by passage of the adsorbate from the surface to the volume of the solid phase into the adsorption sites.

In an embodiment, RCPSA utilizes a structured adsorbent which is incorporated into the tubes utilized in the RSPCA apparatus. These structured adsorbents have an unexpectedly high mass transfer rate since the gas flows through the channels formed by the structured sheets of the adsorbent which offers a significant improvement in mass transfer as compared to a traditional packed fixed bed arrangement as utilized in conventional PSA. The ratio of the transfer rate of the gas phase ($\tau_g$) and the mass transfer rate of the solid phase ($\tau_s$) in the current invention is greater than 10, preferably greater than 25, more preferably greater than 50. These extraordinarily high mass transfer rate ratios allow RCPSA to produce high purity hydrogen streams at high recovery rates with only a fraction of the equipment size, adsorbent volume, and cost of conventional PSA.

The structured adsorbent embodiments also results in significantly greater pressure drops to be achieved through the adsorbent than conventional PSA without the detrimental effects associated with particulate bed technology. The adsorbent beds can be designed with adsorbent bed unit length pressure drops of greater than 5 inches of water per foot of bed length, more preferably greater than 10 in. $H_2O$/ft, and even more preferably greater than 20 in. $H_2O$/ft. This is in contrast with conventional PSA units where the adsorbent bed unit length pressure drops are generally limited to below about 5 in. $H_2O$/ft depending upon the adsorbent used, with most conventional PSA units being designed with a pressure drop of about 1 in. $H_2O$/ft or less to minimize the problems discussed that are associated with the larger beds, long cycle time, and particulate absorbents of conventional PSA units. The adsorbent beds of conventional PSA cannot accommodate higher pressure drops because of the risk of fluidizing the beds which results in excessive attrition and premature unit shutdowns due to accompanying equipment problems and/or a need to add or replace lost adsorbent materials. These markedly higher adsorbent bed unit length pressure drops allow RCPSA adsorbent beds to be significantly more compact, shorter, and efficient than those utilized in conventional PSA.

In an embodiment, high unit length pressure drops allow high vapor velocities to be achieved across the structured adsorbent beds. This results in a greater mass contact rate between the process fluids and the adsorbent materials in a unit of time than can be achieved by conventional PSA. This results in shorter bed lengths, higher gas phase transfer rates ($\tau_g$) and improved hydrogen recovery. With these significantly shorter bed lengths, total pressure drops of the RSCPA application of the present invention can be maintained at total bed pressure differentials during the feed cycle of about 0.5 to 50 psig, preferably less than 30 psig, while minimizing the length of the active beds to normally less than 5 feet in length, preferably less than 2 feet in length and as short as less than 1 foot in length.

The absolute pressure levels employed during the RCPSA process are not critical. In practice, provided that the pressure differential between the adsorption and desorption steps is sufficient to cause a change in the adsorbate fraction loading on the adsorbent thereby providing a delta loading effective for separating the stream components processed by the RCPSA unit. Typical absolute operating pressure levels range from about 50 to 2500 psia. However, it should be noted that the actual pressures utilized during the feed, depressurization, purge and repressurization stages are highly dependent upon many factors including, but not limited to, the actual operating pressure and temperature of the overall stream to be separated, stream composition, and desired recovery percentage and purity of the RCPSA product stream. The RCPSA process is not specifically limited to any absolute pressure and due to its compact size becomes incrementally more economical than conventional PSA processes at the higher operating pressures. U.S. Pat. Nos. 6,406,523; 6,451,095; 6,488, 747; 6,533,846 and 6,565,635, all of which are incorporated herein by reference, disclose various aspects of RCPSA technology.

In an embodiment and an example, the rapid cycle pressure swing adsorption system has a total cycle time, $t_{TOT}$, to separate a feed gas into product gas (in this case, a hydrogen-enriched stream) and a tail (exhaust) gas. The method generally includes the steps of conducting the feed gas having a hydrogen purity F %, where F is the percentage of the feed gas which is the weakly-adsorbable (hydrogen) component, into an adsorbent bed that selectively adsorbs the tail gas and passes the hydrogen product gas out of the bed, for time, $t_F$, wherein the hydrogen product gas has a purity of P % and a rate of recovery of R %. Recovery R % is the ratio of amount of hydrogen retained in the product to the amount of hydrogen available in the feed. Then the bed is co-currently depressurized for a time, $t_{CO}$, followed by counter-currently depressurizing the bed for a time, $t_{CN}$, wherein desorbate (tail gas or exhaust gas) is released from the bed at a pressure greater than or equal to 1 psig. The bed is purged for a time, $t_P$, typically with a portion of the hydrogen product gas. Subsequently the bed is repressurized for a time, $t_{RP}$, typically with a portion of hydrogen product gas or feed gas, wherein the cycle time, $t_{TOT}$, is equal to the sum of the individual cycle times comprising the total cycle time, i.e.:

$$t_{TOT}=t_F+t_{CO}+t_{CN}+t_P+t_{RP} \quad (3)$$

This embodiment encompasses, but is not limited to, RCPSA processes such that either the rate of recovery, R %>80% for a product purity to feed purity ratio, P %/F %>1.1, and/or the rate of recovery, R %>90% for a product purity to feed purity ratio, 0<P %/F %<1.1. Results supporting these high recovery & purity ranges can be found in Examples 4 through 10 herein. Other embodiments will include applications of RCPSA in processes where hydrogen recovery rates are significantly lower than 80%. Embodiments of RCPSA are not limited to exceeding any specific recovery rate or purity thresholds and can be as applied at recovery rates and/or purities as low as desired or economically justifiable for a particular application.

It should also be noted that it is within the scope of this invention that steps $t_{CO}$, $t_{CN}$, or $t_P$ of equation (3) above can be omitted together or in any individual combination. However it is preferred that all steps in the above equation (3) be performed or that only one of steps $t_{CO}$ or $t_{CN}$ be omitted from the total cycle. However, additional steps can also be added within a RCPSA cycle to aid in enhancing purity and recovery of hydrogen. Thus enhancement could be practically achieved in RCPSA because of the small portion of absorbent needed and due to the elimination of a large number of stationary valves utilized in conventional PSA applications.

In an embodiment, the tail gas is also preferably released at a pressure high enough so that the tail gas may be fed to another device absent tail gas compression. More preferably the tail gas pressure is greater than or equal to 60 psig. In a most preferred embodiment, the tail gas pressure is greater than or equal to 80 psig. At higher pressures, the tail gas can be conducted to a fuel header.

Practice of the present invention can have the following benefits:

(i) Increasing the purity of hydrogen-containing stream(s) available as makeup gas, or of streams which must be upgraded to higher purity before they are suitable as make-up gas.

(ii) Increasing the purity of hydrogen-containing recycle gas streams resulting in an increase in overall hydrogen treat gas purity in the hydrotreating reactors to allow for higher hydrotreating severity or additional product treating.

(iii) Use for $H_2$ recovery from hydroprocessing purge gases, either where significant concentrations of $H_2S$ are present (before gas scrubbing) or after gas scrubbing (typically <100 vppm $H_2S$).

In hydroprocessing, increased $H_2$ purity translates to higher $H_2$ partial pressures in the hydroprocessing reactor(s). This both increases the reaction kinetics and decreases the rate of catalyst deactivation. The benefits of higher $H_2$ partial pressures can be exploited in a variety of ways, such as: operating at lower reactor temperature, which reduces energy costs, decreases catalyst deactivation, and extends catalyst life; increasing unit feed rate; processing more sour (higher sulfur) feedstocks; processing higher concentrations of cracked feedstocks; improved product color, particularly near end of run; debottlenecking existing compressors and/or treat gas circuits (increased scf $H_2$ at constant total flow, or same scf $H_2$ at lower total flow); and other means that would be apparent to one skilled in the art.

Increased $H_2$ recovery also offers significant potential benefits, some of which are described as follows:

(i) reducing the demand for purchased, manufactured, or other sources of $H_2$ within the refinery;

(ii) increasing hydroprocessing feed rates at constant (existing) makeup gas demands as a result of the increased hydrogen recovery;

(iii) improving the hydrogen purity in hydroprocessing for increased heteroatom removal efficiencies;

(iv) removing a portion of the $H_2$ from refinery fuel gas which is detrimental to the fuel gas due to hydrogen's low BTU value which can present combustion capacity limitations and difficulties for some furnace burners;

(v) Other benefits that would be apparent to one knowledgeable in the art.

The following examples are presented for illustrative purposes only and should not be cited as being limiting in any way.

EXAMPLES

Examples 1 through 3 show the benefits of improved hydrogen purity through the use of a rapid cycle pressure swing adsorption (RCPSA) to treat a portion of a hydrotreating unit's recycle gas stream. Using the "base case" hydrotreating operation wherein a rapid cycle pressure swing adsorption unit is not used, the following cases illustrate several examples of the benefits of RCPSA in conjunction with a hydrotreating process. In Examples 1 through 3, the treat gas (recycle gas) rate=30.0 Mscf/D, the RCPSA feed rate=6.0 Mscf/D, the $H_2$ recovery rate=95%, and the RCPSA $H_2$ product purity=95%.

Example 1

In this example, RCPSA is used to treat 6.0 Mscf/D of recycle gas (about ⅕ of the total recycle stream volumetric flow). RCPSA performance is assumed to be 95% $H_2$ recovery with 95% $H_2$ purity in the product. The RCPSA exhaust stream now removes light end impurities from the recirculating gas loop, and the conventional hydrotreating purge stream has been lowered to 0.3 Mscf/D of $H_2$. The results are shown as Case 01 in Table 1. Compared to the base operation at the same feed rate and sulfur removal severity, (a) the treat gas purity at reactor inlet has increased from 80 to 91.5 mole % $H_2$; (b) the required makeup gas flow rate has decreased from 12.07 to 11.28 Mscf/D; and (c) $H_2$ purged from the system (lost to fuel gas) has been reduced from 1.06 to 0.3 Mscf/D.

Example 2

In this example, again, RCPSA is used to treat 6.0 Mscf/D of recycle gas (about ⅕ of the total recycle stream volumetric flow) with 95% $H_2$ recovery and 95% $H_2$ purity in the product. The results are shown as Case 02 in Table 1. In this case, the unit feed rate was increased until the original 13.1 Mscf/D makeup gas rate was required. The increase in $H_2$ purity at the same $H_2$ make-up rate resulted in (a) an increase from 30,000 to 32,150 B/D at a constant sulfur removal specification; (b) an improved treat gas purity of 91.4 mole % $H_2$; and (c) $H_2$ purged from the system (lost to fuel gas) has been reduced from 1.06 to 0.3 Mscf/D.

Example 3

In this example, the original 30 kB/D feed rate and 12.07 Mscf/D make-up gas rate are maintained. The results are shown as Case 03 in Table 1. Again, RCPSA is used to treat 6.0 Mscf/D of recycle gas (about ⅕ of the total recycle stream volumetric flow) with 95% $H_2$ recovery and 95% $H_2$ purity in the product. Here, the increase in $H_2$ purity as a result of the RCPSA application operation on a portion of the recycle gas flow allows (a) the sulfur in the feed to increase by 0.18% while maintaining the same product sulfur specifications as the base case; (b) a corresponding overall hydrogen consumption increase of +26 scf/B with no corresponding increase in make-up gas demand, and (c) $H_2$ purged from the system (lost to fuel gas) to be reduced from 1.06 to 0.3 Mscf/D.

Additionally, Examples 1 and 2 would also result in about 15 to 40% longer run lengths between catalyst change-out. The various operating conditions and projected run lengths of this unit's "base" current operation and Cases 01 through 03 are summarized in Table 1 below.

show how the hydrogen purity decreases as recovery is increased from 89.7% to 91.7% for a 6 MMSCFD stream at 480 psig and tail gas at 65 psig.

Tables 2a & 2b

Composition (mol %) of Input and Output from RCPSA (67 $ft^3$) in H2 Purification. Feed is at 480 psig, 122 deg F. and Tail Gas at 65 psig. Feed Rate is about 6 MMSCFD TABLE 2a Higher purity
Step Times in seconds are $t_F = 1$, $t_{CO} = 0.167$, $t_{CN} = 0$, $t_P = 0.333$, $t_{RP} = 0.5$
H2 at 98.6% purity, 89.7% recovery

| | feed | product | Tail-Gas |
|---|---|---|---|
| H2 | 88.0 | 98.69 | 45.8. |
| C1 | 6.3 | 1.28 | 25.1 |
| C2 | 0.2 | 0.01 | 1.0 |
| C3 | 2.6 | 0.01 | 12.3 |
| C4+ | 2.9 | 0.00 | 14.8 |
| H2O | 2000 vppm | 65 vppm | 9965 vppm |
| total (MMSCFD) | 6.162 | 4.934 | 1.228 |
| | 480 psig | 470 psig | 65 psig |

TABLE 1

Summary of Hydrotreating Benefits - RCPSA on a Portion of H/T Recycle Flow

| | | | | Treat Gas at Reactor Inlet | | | | Makeup | H2 Purity, | H2 Loss | SOR | EOR | Estimated |
|---|---|---|---|---|---|---|---|---|---|---|---|---|---|
| Case | Feed, kB/D | Feed wt % S | Reactor Size | Mscf/D | scf/B | mole % H2 Purity | H2 cons. + Sol., scf/B | Mscf H2/D (92.06%) | RCPSA Feed | from unit, Mscf H2/D | EIT, ° F. | EIT, ° F. | Run Length, Months |
| Base | 30.0 | 0.80 | (Base) | 30 | 1000 | 80.0 | 367 | 12.07 | — | 1.06 | 649 | 699 | 20 |
| 01 | 30.0 | 0.80 | " | 30 | 1000 | 91.5 | 367 | 11.28 | 89.3 | 0.3 | 645 | 699 | 28 |
| 01-B | 30.0 | 0.80 | " | 30 | 1000 | 88.8 | 367 | 11.52 | 84.9 | 0.5 | 646 | 699 | 26 |
| 02 | 32.15 | 0.80 | " | 30 | 933 | 91.4 | 367 | 12.07 | 88.9 | 0.3 | 649 | 699 | 23 |
| 03 | 30.0 | 0.98 | " | 30 | 1000 | 91.1 | 393 | 12.07 | 88.3 | 0.3 | 653 | 699 | 19 |
| 04 | 30.0 | 0.80 | −11% | 30 | 1000 | 91.5 | 367 | 11.28 | 89.3 | 0.3 | 652½ | 699 | 20 |

In Cases 01, 02, 03, 04: TGR = 30 Mscf/D; RCPSA = 6.0 Mscf/D Feed, 95% H2 recovery & 95% H2 Product Purity
In Case 01-B: TGR = 30 Mscf/D; RCPSA = 6.0 Mscf/D Feed, 90% H2 recovery & 90% H2 Product Purity Example 4

In this example, the refinery stream is at 480 psig with tail gas at 65 psig whereby the pressure swing is 6.18. The feed composition and pressures are typical of refinery processing units such as those found in hydroprocessing or hydrotreating applications. In this example typical hydrocarbons are described by their carbon number i.e. $C_1$=methane, $C_2$=ethane etc. The RCPSA is capable of producing hydrogen at >99% purity and >81% recovery over a range of flow rates. Tables 2a and 2b show the results of computer simulation of the RCPSA and the input and output percentages of the different components for this example. Tables 2a and 2b also TABLE 2b Higher purity
Step Times in seconds are $t_F = 1$, $t_{CO} = 0.333$, $t_{CN} = 0$, $t_P = 0.167$, $t_{RP} = 0.5$
H2 at 97.8% purity, 91.7% recovery

| | feed | product | Tail-Gas |
|---|---|---|---|
| H2 | 88.0 | 97.80 | 45.9 |
| C1 | 6.3 | 2.14 | 25.0 |
| C2 | 0.2 | 0.02 | 1.0 |
| C3 | 2.6 | 0.02 | 12.3 |
| C4+ | 2.9 | 0.00 | 14.9 |
| H2O | 2000 vppm | 131 vppm | 10016 vpm |

TABLE 2b-continued

| Higher purity<br>Step Times in seconds are $t_F = 1$, $t_{CO} = 0.333$, $t_{CN} = 0$, $t_P = 0.167$, $t_{RP} = 0.5$<br>H2 at 97.8% purity, 91.7% recovery | | | |
|---|---|---|---|
| | feed | product | Tail-Gas |
| total (MMSCFD) | 6.160<br>480 psig | 5.085<br>470 psig | 1.074<br>65 psig |

The RCPSA's described in the present invention operate a cycle consisting of different steps. Step 1 is feed during which product is produced, step 2 is co-current depressurization, step 3 is counter-current depressurization, step 4 is purge, usually counter-current) and step 5 is repressurization with product. In the RCPSA's described here at any instant half the total number of beds is on the feed step. In this example, $t_{TOT}$=2 sec in which the feed time, $t_F$, is one-half of the total cycle.

Example 5

In this example, the conditions are the same as in Example 4. Table 3a shows conditions utilizing both a co-current and counter-current steps to achieve hydrogen purity >99%. Table 3b shows that the counter-current depressurization step may be eliminated, and a hydrogen purity of 99% can still be maintained. In fact, this shows that by increasing the time of the purge cycle, $t_P$, by the duration removed from the counter-current depressurization step, $t_{CN}$, that hydrogen recovery can be increased to a level of 88%.

Tables 3a & 3b

Effect of Step Durations on H2 Purity and Recovery from an RCPSA (67 $ft^3$). Same Conditions as Table 1. Feed is at 480 psig, 122 deg F. and Tail Gas at 65 psig. Feed Rate is about 6 MMSCFD TABLE 3a

| With counter-current depress, Intermediate pressure = 105 psig | | | | | | |
|---|---|---|---|---|---|---|
| purity % | recovery % | $t_F$ s | $t_{CO}$ s | $t_{CN}$ s | $t_P$ s | $t_{RP}$ s |
| 98.2 | 84.3 | 1 | 0.283 | 0.05 | 0.167 | 0.5 |
| 98.3 | 85 | 1 | 0.166 | 0.167 | 0.167 | 0.5 |
| 99.9 | 80 | 1 | 0.083 | 0.25 | 0.167 | 0.5 |

TABLE 3b

| Without counter-current depress | | | | | | |
|---|---|---|---|---|---|---|
| purity % | recovery % | $t_F$ s | $t_{CO}$ s | $t_{CN}$ s | $t_P$ s | $t_{RP}$ s |
| 97.8 | 91.7 | 1 | 0.333 | 0 | 0.167 | 0.5 |
| 98.7 | 90 | 1 | 0.166 | 0 | 0.334 | 0.5 |
| 99 | 88 | 1 | 0.083 | 0 | 0.417 | 0.5 |

Example 6

This example shows a 10 MMSCFD refinery stream, once again containing typical components, as shown in feed column of Table 4 (e.g. the feed composition contains 74% $H_2$). The stream is at 480 psig with RCPSA tail gas at 65 psig whereby the absolute pressure swing is 6.18. Once again the RCPSA of the present invention is capable of producing hydrogen at >99% purity and >85% recovery from these feed compositions. Tables 4a and 4b show the results of this example.

Tables 4a & 4b

Composition (mol %) of Input and Output from RCPSA (53 $ft^3$) in H2 Purification. Feed is at 480 psig, 101 deg F. and Tail Gas at 65 psig. Feed rate is about 10 MMSCFD TABLE 4a

| Higher purity<br>Step Times in seconds are $t_F = 0.583$, $t_{CO} = 0.083$, $t_{CN} = 0$, $t_P = 0.25$, $t_{RP} = 0.25$<br>H2 at 99.98% purity and 86% recovery | | | |
|---|---|---|---|
| | feed | product | Tail-Gas |
| H2 | 74.0 | 99.98 | 29.8 |
| C1 | 14.3 | 0.02 | 37.6 |
| C2 | 5.2 | 0.00 | 13.8 |
| C3 | 2.6 | 0.00 | 7.4 |
| C4+ | 3.9 | 0.00 | 11.0 |
| H2O | 2000 vppm | 0.3 vppm | 5387 vppm |
| total (MMSCFD) | 10.220<br>480 psig | 6.514<br>470 psig | 3.705<br>65 psig |

TABLE 4b

| Lower purity<br>Step Times in seconds are $t_F = 0.5$, $t_{CO} = 0.167$, $t_{CN} = 0$, $t_P = 0.083$, $t_{RP} = 0.25$<br>H2 at 93% purity and 89% recovery | | | |
|---|---|---|---|
| | feed | product | Tail-Gas |
| H2 | 74.0 | 93.12 | 29.3 |
| C1 | 14.3 | 6.34 | 31.0 |
| C2 | 5.2 | 0.50 | 16.6 |
| C3 | 2.6 | 0.02 | 8.9 |
| C4+ | 3.9 | 0.00 | 13.4 |
| H2O | 2000 vppm | 142 vppm | 6501 vpm |
| total (MMSCFD) | 10.220<br>480 psig | 7.240<br>470 psig | 2.977<br>65 psig |

In both cases shown in Table 4a and 4b above, although tail gas pressure is high at 65 psig, the present invention shows that high purity (99%) may be obtained if the purge step, $t_P$, is sufficiently increased.

Tables 3a, 3b and 4a show that for both 6 MMSCFD and 10 MMSCFD flow rate conditions, very high purity hydrogen at ~99% and >85% recovery is achievable with the RCPSA. In both cases the tail gas is at 65 psig. Such high purities and recoveries of product gas achieved using the RCPSA with all the exhaust produced at high pressure have not been discovered before and are a key feature of the present invention.

Table 4c shows the results for an RCPSA (volume=49 cubic ft) that delivers high purity (>99%) $H_2$ at high recovery for the same refinery stream discussed in Tables 4a and 4b. As compared to Table 4a, Table 4c shows that similar purity and recovery rates can be achieved by simultaneously decreasing the duration of the feed cycle, $t_F$, and the purge cycle, $t_P$.

TABLE 4c

Effect of step durations on H2 purity and recovery from an RCPSA (49 $ft^3$). Feed is at 480 psig, 101 deg F. and Tail gas at 65 psig. Feed rate is about 10 MMSCFD. Without counter-current depress

| purity % | recovery % | $t_F$ s | $t_{CO}$ s | $t_{CN}$ s | $t_P$ s | $t_{RP}$ s |
|---|---|---|---|---|---|---|
| 95.6 | 87.1 | 0.5 | 0.167 | 0 | 0.083 | 0.25 |
| 97.6 | 86 | 0.5 | 0.117 | 0 | 0.133 | 0.25 |
| 99.7 | 85.9 | 0.5 | 0.083 | 0 | 0.167 | 0.25 |

Example 7

In this example, Table 5 further illustrates the performance of RCPSA's operated in accordance with the invention being described here. In this example, the feed is a typical refinery stream and is at a pressure of 300 psig. The RCPSA of the present invention is able to produce 99% pure hydrogen product at 83.6% recovery when all the tail gas is exhausted at 40 psig. In this case the tail gas can be sent to a flash drum or other separator or other downstream refinery equipment without further compression requirement. Another important aspect of this invention is that the RCPSA also removes CO to <2 vppm, which is extremely desirable for refinery units that use the product hydrogen enriched stream. Lower levels of CO ensure that the catalysts in the downstream units operate without deterioration in activity over extended lengths. Conventional PSA cannot meet this CO specification and simultaneously also meet the condition of exhausting all the tail gas at the higher pressure, such as at typical fuel header pressure or the high pressure of other equipment that processes such RCPSA exhaust. Since all the tail gas is available at 40 psig or greater, no additional compression is required for integrating the RCPSA with refinery equipment.

TABLE 5

Composition (mol %) of input and output from RCPSA (4 $ft^3$) in carbon monoxide and hydrocarbon removal from hydrogen. Feed is at 300 psig, 101 deg F., and Feed rate is about 0.97 MMSCFD. Step Times in seconds are $t_F = 0.5$, $t_{CO} = 0.1$, $t_{CN} = 0$, $t_P = 0.033$, $t_{RP} = 0.066$ H2 at 99.99% purity and 88% recovery

| | feed | product | Tail-Gas |
|---|---|---|---|
| H2 | 89.2 | 99.98 | 48.8 |
| C1 | 3.3 | 0.01 | 13.9 |
| C2 | 2.8 | 0.01 | 13.9 |
| C3 | 2.0 | 0.00 | 10.2 |
| C4+ | 2.6 | 0.00 | 13.2 |
| CO | 50 | 1.1 | 198.4 |
| total | 0.971 | 0.760 | 0.211 |
| | 300 psig | 290 psig | 40 psig |

Example 8

Tables 6a and 6b compare the performance of RCPSA's operated in accordance with the invention being described here. The stream being purified has lower $H_2$ in the feed (51% mol) and is a typical refinery/petrochemical stream. In both cases (corresponding to Tables 6a and 6b), a counter current depressurization step is applied after the co-current step. In accordance with the invention, Table 6a shows that high $H_2$ recovery (81%) is possible even when all the tail gas is released at 65 psig or greater. In contrast, the RCPSA where some tail-gas is available as low as 5 psig, loses hydrogen in the counter-current depressurization such that $H_2$ recovery drops to 56%. In addition, the higher pressure of the stream in Table 6a indicates that no tail gas compression is required.

Tables 6a & 6b

Effect of Tail Gas Pressure on Recovery

Example of RCPSA Applied to a Feed with H2 Concentration (51.3 mol %)

Composition (mol %) of Input and Output from RCPSA (31 $ft^3$) in H2 Purification. Feed is at 273 psig, 122 deg F. and Feed Rate is about 5.1 MMSCFD TABLE 6a Step Times in seconds are $t_F = 0.5$, $t_{CO} = 0.083$, $t_{CN} = 0.033$, $t_P = 0.25$, $t_{RP} = 0.133$ [a] Tail gas available from 65-83 psig, H2 at 99.7% purity and 81% recovery

| | feed | product | Tail-Gas |
|---|---|---|---|
| H2 | 51.3 | 99.71 | 20.1 |
| C1 | 38.0 | 0.29 | 61.0 |
| C2 | 4.8 | 0.00 | 8.0 |
| C3 | 2.2 | 0.00 | 3.8 |
| C4+ | 3.7 | 0.00 | 6.4 |
| H2O | 4000 vppm | 0.7 vppm | 6643 vppm |
| total (MMSCFD) | 5.142 | 2.141 | 3.001 |
| | 273 psig | 263 psig | 65-83 psig |

TABLE 6b

Step Times in sec. are $t_F = 0.667$, $t_{CO} = 0.167$, $t_{CN} = 0.083$, $t_P = 0.083$, $t_{RP} = 0.33$ [b] Tail gas available from 5-65 psig, H2 at 99.9% purity and 56% recovery

| | feed | product | Tail-Gas |
|---|---|---|---|
| H2 | 51.3 | 99.99 | 34.2 |
| C1 | 38.0 | 0.01 | 48.8 |
| C2 | 4.8 | 0.00 | 6.9 |
| C3 | 2.2 | 0.00 | 3.4 |
| C4+ | 3.7 | 0.00 | 6.2 |
| H2O | 4000 vppm | 0.0 vppm | 5630 vppm |
| total (MMSCFD) | 5.142 | 1.490 | 3.651 |
| | 273 psig | 263 psig | 5-65 psig |

Example 9

In this example, Tables 7a and 7b compare the performance of RCPSA's operated in accordance with the invention being described here. In these cases, the feed pressure is 800 psig and tail gas is exhausted at either 65 psig or at 100 psig. The composition reflects typical impurities such H2S, which can be present in such refinery applications. As can be seen, high recovery (>80%) is observed in both cases with the high purity >99%. In both these cases, only a co-current depressurization is used and the effluent during this step is sent to other beds in the cycle. Tail gas only issues during the countercurrent purge step. Table 7c shows the case for an RCPSA operated where some of the tail gas is also exhausted in a countercurrent depressurization step following a co-current depressurization. The effluent of the co-current depressurization is of sufficient purity and pressure to be able to return it one of the other beds in the RCPSA vessel configuration that is part of this invention. Tail gas i.e., exhaust gas, issues during the counter-current depressurization and the counter-current purge steps.

In all cases the entire amount of tail gas is available at elevated pressure which allows for integration with other high pressure refinery process. This removes the need for any form of required compression while producing high purity gas at high recoveries. In accordance with the broad claims of this invention, these cases are only to be considered as illustrative examples and not limiting either to the refinery, petrochemical or processing location or even to the nature of the particular molecules being separated.

Tables 7a, 7b, & 7c

Example of RCPSA Applied to a High Pressure Feed Composition (mol %) of Input and Output from RCPSA (18 $ft^3$) in H2 Purification. Feed is at 800 psig, 122 deg F. and Feed Rate is about 10.1 MMSCFD 7a. Step Times in seconds are $t_F = 0.91$, $t_{CO} = 0.25$, $t_{CN} = 0$, $t_P = 0.33$, $t_{RP} = 0.33$
[a] Tail gas at 65 psig, H2 at 99.9% purity and 87% recovery

| | feed | product | Tail-Gas |
|---|---|---|---|
| H2 | 74.0 | 99.99 | 29.5 |
| C1 | 14.3 | 0.01 | 37.6 |
| C2 | 5.2 | 0.00 | 14.0 |
| C3 | 2.6 | 0.00 | 7.4 |
| C4+ | 3.9 | 0.00 | 10.9 |
| H2S | 20 vppm | 0 | 55 vppm |
| total (MMSCFD) | 10.187 | 6.524 | 3.663 |
| | 800 psig | 790 psig | 65 psig |

7b. Step Times in seconds are $t_F = 0.91$, $t_{CO} = 0.25$, $t_{CN} = 0$, $t_P = 0.33$, $t_{RP} = 0.33$
[b] Tail gas at 100 psig, H2 at 99.93% purity and 80.3% recovery

| | feed | product | Tail-Gas |
|---|---|---|---|
| H2 | 74.0 | 99.93 | 38.1 |
| C1 | 14.3 | 0.07 | 32.8 |
| C2 | 5.2 | 0.00 | 12.5 |
| C3 | 2.6 | 0.00 | 6.5 |
| C4+ | 3.9 | 0.00 | 9.6 |
| H2S | 20 vppm | 0 vppm | 49 vppm |
| total (MMSCFD) | 10.187 | 6.062 | 4.125 |
| | 800 psig | 790 psig | 100 psig |

7c. Step Times in seconds are $t_F = 0.91$, $t_{CO} = 0.083$, $t_{CN} = 0.25$, $t_P = 0.167$, $t_{RP} = 0.41$
[c] Tail gas from 65-100 psig, H2 at 99.8% purity and 84% recovery

| | feed | product | Tail-Gas |
|---|---|---|---|
| H2 | 74.0 | 99.95 | 28.9 |
| C1 | 14.3 | 0.05 | 39.0 |
| C2 | 5.2 | 0.00 | 13.7 |
| C3 | 2.6 | 0.00 | 7.2 |
| C4+ | 3.9 | 0.00 | 10.6 |
| H2S | 20 vppm | 0.01 vppm | 53 vppm |

-continued

7c. Step Times in seconds are $t_F = 0.91$, $t_{CO} = 0.083$, $t_{CN} = 0.25$, $t_P = 0.167$, $t_{RP} = 0.41$
[c] Tail gas from 65-100 psig, H2 at 99.8% purity and 84% recovery

| | feed | product | Tail-Gas |
|---|---|---|---|
| total (MMSCFD) | 10.187 | 6.373 | 3.814 |
| | 800 psig | 790 psig | 65-100 psig |

Example 10

Tables 8a, 8b, and 8c compare the performance of RCPSA's operated in accordance with the invention being described here. The stream being purified has higher $H_2$ in the feed (85% mol) and is a typical refinery/petrochemical stream. In these examples the purity increase in product is below 10% (i.e. P/F<1.1). Under this constraint, the method of the present invention is able to produce hydrogen at >90% recovery without the need for tail gas compression.

Tables 8a, 8b, & 8c

Example of RCPSA Applied to a Feed with H2 Concentration (85 mol %). Composition (mol %) of Input and Output from RCPSA (6.1 $ft^3$). Feed is at 480 psig, 135 deg F. and Feed Rate is about 6 MMSCFD 8a. Step Times in seconds are $t_F = 0.5$, $t_{CO} = 0.33$, $t_{CN} = 0.167$, $t_P = 0.167$, $t_{RP} = 1.83$ recovery = 85%

| | feed | product | Tail-Gas |
|---|---|---|---|
| H2 | 85.0 | 92.40 | 57.9 |
| C1 | 8.0 | 4.56 | 17.9 |
| C2 | 4.0 | 1.79 | 13.1 |
| C3 | 3.0 | 1.16 | 10.4 |
| C4+ | 0.0 | 0.00 | 0.0 |
| H2O | 2000 | 866.5 | 6915 |
| total (MMSCFD) | 6.100 | 4.780 | 1.320 |
| | 480 psig | 470 psig | 65 psig |

8b. Step Times in sec. are $t_F = 1$, $t_{CO} = 0.333$, $t_{CN} = 0.167$, $t_P = 0.083$, $t_{RP} = 0.417$ recovery = 90%

| | feed | product | Tail-Gas |
|---|---|---|---|
| H2 | 85.0 | 90.90 | 58.2 |
| C1 | 8.0 | 5.47 | 18.1 |
| C2 | 4.0 | 2.23 | 12.9 |
| C3 | 3.0 | 1.29 | 10.1 |
| C4+ | 0.0 | 0.00 | 0.0 |
| H2O | 2000 | 1070.5 | 6823 |
| total (MMSCFD) | 6.120 | 5.150 | 0.969 |
| | 480 psig | 470 psig | 65 psig |

8c. Step Times in sec. are $t_F = 2$, $t_{CO} = 0.667$, $t_{CN} = 0.333$, $t_P = 0.167$, $t_{RP} = 0.833$ recovery = 90%

| | feed | product | Tail-Gas |
|---|---|---|---|
| H2 | 85.0 | 90.19 | 55.2 |
| C1 | 8.0 | 6.21 | 18.8 |
| C2 | 4.0 | 2.32 | 13.9 |
| C3 | 3.0 | 1.17 | 11.3 |
| C4+ | 0.0 | 0.00 | 0.0 |
| H2O | 2000 | 1103.5 | 7447 |
| total (MMSCFD) | 6.138 | 5.208 | 0.93 |
| | 480 psig | 470 psig | 65 psig |

What is claimed is:

1. A process for removing sulfur and other heteroatoms from a hydrocarbon feed, comprising:

a) contacting the hydrocarbon feed in a hydrotreating zone with hydrogen and a catalytically effective amount of a hydrotreating catalyst under hydrotreating conditions thereby resulting in a hydrotreated product comprised of a liquid phase and a vapor phase containing hydrogen and light hydrocarbons;

b) separating the liquid phase and the vapor phase from the hydrotreated product;

c) removing light hydrocarbons from the vapor phase in a rapid cycle pressure swing adsorption unit containing a plurality of adsorbent beds and having a total cycle time of less than about 30 seconds and a pressure drop within each adsorbent bed of greater than about 5 inches of water per foot of bed length to produce a purified recycle gas with a higher concentration by vol % than the vapor phase; and d) recycling at least a portion of the purified recycle gas to the hydrotreating zone, wherein the removing step c) results in a recovery of a purified hydrogen-containing gas stream, relative to said hydrogen-containing make-up treat gas, said vapor phase product, or both, so as to exhibit (i) a rate of recovery (R %) greater than 80% for a product purity to feed ratio (P %/F %) greater than 1.1, (ii) a rate of recovery (R %) greater than 90% for a product purity to feed ratio (P %/F %) less than 1.1 but greater than 0, or (iii) both (i) and (ii).

2. The process of claim 1, wherein the hydrocarbon feed is selected from the group consisting of naphtha boiling range feeds, kerosene boiling range feeds, and distillate boiling range feeds.

3. The process of claim 2, wherein the hydrocarbon feed is a naphtha boiling range feed selected from the group consisting of straight run naphtha, cat cracked naphtha, coker naphtha, hydrocracker naphtha, and resid hydrotreater naphtha.

4. The process of claim 2, wherein the hydrocarbon feed is a distillate and higher boiling range feed selected from the group consisting of cycle oils produced from the Fluid Catalytic Cracker (FCC), atmospheric and vacuum gas oils, atmospheric and vacuum residua, pyrolysis gasoline, Fischer-Tropsch liquids and waxes, lube oils, and crudes.

5. The process of claim 2, wherein the total cycle time of rapid cycle pressure swing adsorption is less than about 15 seconds.

6. The process of claim 5, wherein the total cycle time is less than about 10 seconds and the pressure drop is greater than about 10 inches of water per foot of bed length.

7. The process of claim 6, wherein the total cycle time is less than about 5 seconds.

8. The process of claim 7, wherein the pressure drop of greater than about 20 inches of water per foot of bed length.

9. The process of claim 6, wherein the hydrotreating catalyst contains at least one of cobalt, nickel, molybdenum, platinum, tungsten, alumina, silica, silica-alumina, a zeolite, and a molecular sieve.

10. The process of claim 6, wherein the liquid phase is blended into a fuel product.

11. The process of claim 1, wherein the total cycle time is less than about 10 seconds and the pressure drop is greater than about 10 inches of water per foot of bed length.

12. The process of claim 11, wherein the cycle time is less than about 5 seconds and the pressure drop is greater than about 20 inches of water per foot of bed length.

13. The process of claim 1, wherein hydrogen sulfide and ammonia are removed from said vapor phase with a basic scrubbing solution prior to removing light hydrocarbons from the vapor phase in a rapid cycle pressure swing adsorption unit.

14. The process of claim 13, wherein the total cycle time is less than about 10 seconds and the pressure drop is greater than about 10 inches of water per foot of bed length.

15. The process of claim 14, wherein the total cycle time is less than about 5 seconds the pressure drop is greater than about 20 inches of water per foot of bed length.

16. The process of claim 1, wherein light hydrocarbons are removed from a hydrogen-containing make-up gas in a rapid cycle pressure swing adsorption unit containing a plurality of adsorbent beds and having a total cycle time of less than about 30 seconds and a pressure drop within each adsorbent bed of greater than about 5 inches of water per foot of bed length, to produce a purified make-up gas with a higher hydrogen concentration by vol % than the hydrogen-containing make-up gas, and at least a portion said hydrogen is comprised of at least a portion of said purified make-up gas.

17. The process of claim 16, wherein the hydrocarbon feed is selected from the group consisting of naphtha boiling range feeds, kerosene boiling range feeds, and distillate boiling range feeds.

18. The process of claim 17 wherein the total cycle time of rapid cycle pressure swing adsorption is less than about 10 seconds and the pressure drop in each adsorption bed is greater than about 10 inches of water per foot of bed length.

19. The process of claim 18 wherein the total cycle time is less than about 5 seconds and the pressure drop is greater than about 20 inches of water per foot of bed length.

* * * * *

UNITED STATES PATENT AND TRADEMARK OFFICE

CERTIFICATE OF CORRECTION

PATENT NO. : 8,518,244 B2
APPLICATION NO. : 11/795547
DATED : August 27, 2013
INVENTOR(S) : Schorfheide et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 976 days.

Signed and Sealed this
Fifteenth Day of September, 2015

Michelle K. Lee

Michelle K. Lee
*Director of the United States Patent and Trademark Office*